US005217262A

United States Patent [19]

Kurosaki

[11] Patent Number: 5,217,262

[45] Date of Patent: Jun. 8, 1993

[54] LATCH DEVICE HAVING TWO TRACING MEMBERS FOR AUTOMATIC RELEASE

[75] Inventor: Mutsuo Kurosaki, Toyota, Japan

[73] Assignee: Nifco Inc., Japan

[21] Appl. No.: 841,793

[22] Filed: Feb. 26, 1992

[30] Foreign Application Priority Data

Mar. 1, 1991 [JP] Japan ..... 3-036305

[51] Int. Cl.[5] ..... E05C 3/02

[52] U.S. Cl. ..... 292/6; 292/DIG. 4

[58] Field of Search ..... 292/6, 19, 45, DIG. 4, 292/180; 24/115 G, 645, 654, 656, 662

[56] References Cited

U.S. PATENT DOCUMENTS

| | | | |
|---|---|---|---|
| 4,527,821 | 7/1985 | Tanaka | 292/19 |
| 4,616,861 | 10/1986 | Kurosaki . | |
| 4,657,291 | 4/1987 | Kurosaki . | |
| 4,660,871 | 4/1987 | Arakawa et al. | 292/81 |
| 4,702,506 | 10/1987 | Iimura | 292/DIG. 4 |
| 4,792,165 | 12/1988 | Nishimura | 292/DIG. 4 |
| 4,917,416 | 4/1990 | Westphal et al. | 292/DIG. 4 |
| 5,090,751 | 2/1992 | Kobayashi | 292/DIG. 4 |

FOREIGN PATENT DOCUMENTS 4-12957 3/1992 Japan .

*Primary Examiner*—Eric K. Nicholson

*Attorney, Agent, or Firm*—Parkhurst, Wendel & Rossi

[57] ABSTRACT

A latch device including a pair of circuital cam grooves having different planar shapes formed in opposite surfaces of a latch body. A guide lever is inserted into the circuital cam grooves so that tips of tracing portions of the guide lever do not contact bottom surfaces of the circuital cam grooves. The circuital cam grooves have a heart-shaped projection and a triangular projection, such that torsion is generated in the tracing portions because of differences in configurations of the circuital cam grooves. A restoring force of the guide lever acting opposite the torsional force causes the tracing portions to circulate in a given direction. As a result, compared with conventional latch devices, fewer components may be used. Wear on the circuital grooves of the latch body can be prevented. When the torsional force is eliminated, the tracing portions move in a direction where the groove wall surfaces are not provided. No unpleasant impact sound (operating sound) is produced because the tracing portions doe not strike against the groove wall surfaces.

12 Claims, 13 Drawing Sheets

LATCH DEVICE HAVING TWO TRACING MEMBERS FOR AUTOMATIC RELEASE

BACKGROUND OF THE INVENTION

The present invention relates to a latch device wherein a latch body is engaged in pushed in and released states within a housing.

DESCRIPTION OF THE RELATED ART

A latch device in which a latch body is engaged in pushed in and released states within a housing is used to latch closing covers of audio equipment and the like.

This latch device is designed so that a tracing portion moves in a heart-shaped circuital groove by a thrusting force acting on the latch body. The latch body is thereby engaged in a pushed in position or in a pulled out state.

As a result, when the closing cover at which the latch device is mounted is driven in a direction in which the cover is closed, a striker provided on the closing cover is held between or released from engaging arms formed on the latch body. The closing cover is thereby either opened or closed.

In a general latch device, such as that shown in FIGS. 13 and 14, a circuital groove 82 is provided with stepped portions 88 at the bottom surface of the groove 82 to allow a tracing portion 86 of a lock member 84 to circulate in a given direction (the direction of arrow H) in the circuital groove 82 formed on a latch body 80. The tracing portion 86 is thereby prevented from circulating in the opposite direction. An urging means 90 is also provided so as to urge the tracing portion 86 of the lock component 84 in the direction of the circuital groove 82, thereby ensuring that a tip of the tracing portion 86 circulates while sliding on the bottom surface of the circuital groove 82.

However, when the latch body is formed of a soft material, such as nylon or the like, and is used in the above-described latch device, in which the stepped portions 88 are formed at the bottom surface of the circuital groove 82 and the urging means 90 is additionally provided, inconveniences arise. Such inconveniences include wear or deformation of the circuital groove being produced by sliding of the tracing portion 86, which is usually formed of a metal material, and movement of the lock member 84 in the opposite direction due to the stepped portions 88 being scraped away.

In addition, the tracing portion 86, which is urged by the urging means 90 in the direction of the circuital groove 82, produces a sound when passing over the stepped portions 88 formed at the bottom surface of the circuital groove 82. Although the emitting of a sound depends on mounting portions of the latch device, such a sound must be eliminated from products from which the consumer demands noise reduction, thus contributing to a sense of high quality.

SUMMARY OF THE INVENTION

In view of the above deficiencies of prior devices, an object of the present invention is to provide a latch device which has fewer components, in which wear on circuital grooves of a latch body is retarded, and in which no operating sound is generated when the latch body is driven therein.

The latch body of the present invention is engaged in pushed in and released states within a housing fixed to mounting plates and the like. The latch device comprises: a pair of circuital cam grooves of different configurations formed respectively in both surfaces of the latch body; an open portion without groove wall surfaces of the circuital cam grooves; and tracing members which are inserted into the circuital cam grooves, are maintained apart from bottom surfaces of the circuital cam grooves, and are forced by movement of the latch body against the groove wall surfaces of the circuital cam grooves. The tracing members then move toward the open portion by a restoring force in a circulating direction of a torsional force generated by the tracing members being thrust, whereby the torsional force is eliminated. The tracing members retain the latch body alternately in the pushed in and released states within the housing with each thrust of the latch body.

In the latch device with the above construction, the tracing members circulate in the pair of circuital cam grooves formed in different portions of the latch body with each thrust on the latch body. The tracing members hold the latch body alternately in the pushed in and pulled out states within the housing.

With the tips of the tracing members inserted in so as to avoid contacting the bottom surfaces of the circuital cam grooves, the tracing members do not wear down the bottom surfaces formed in the circuital cam grooves. Meanwhile, the pair of circuital cam grooves have different shapes. The tracing members tracing these circuital cam grooves are forced against the groove wall surfaces of the circuital cam grooves by movement of the latch body. The torsional force is then imparted to the tracing members. As a result, the restoring force produced by the torsion of the tracing members prevents the tracing members from moving in an opposite direction. Therefore, the tracing members do not move backward but circulate in a given direction even if stepped portions are not formed.

Furthermore, the tips of the tracing members move toward the open portion without the groove wall surfaces when the torsional force is eliminated from the tracing members. Therefore, the tracing members do not strike against the groove wall surfaces, and no impact sound (operating sound) is produced. Accordingly, the present invention results in noise reduction which contributes to a sense of high quality demanded by the consumer.

DESCRIPTION OF THE PREFERRED EMBODIMENTS

Figure 1:
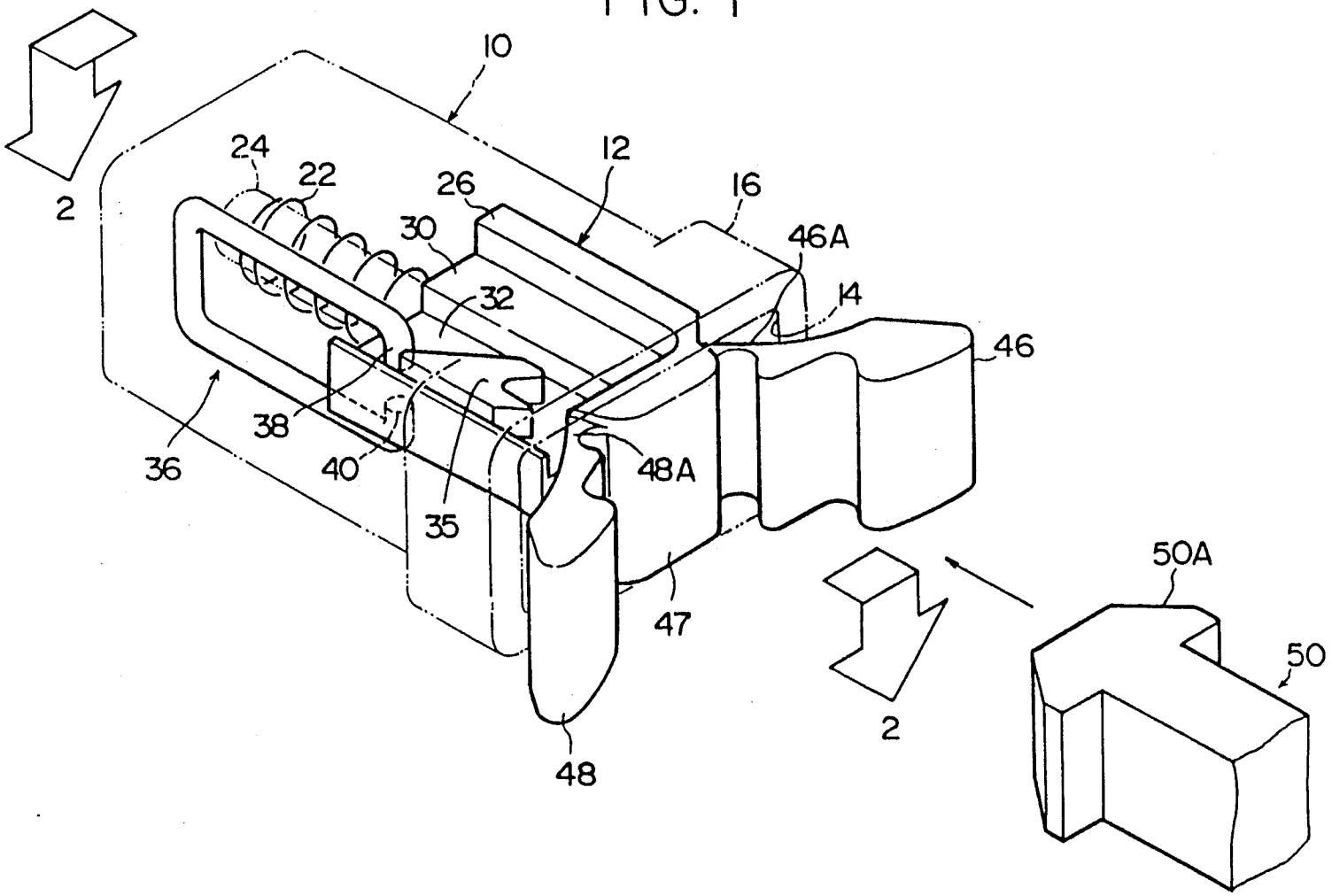
FIG. 1 is a general perspective view showing a latch device according to a first embodiment of the present invention.

As shown in FIG. 1, a latch device L according to the present embodiment contains a latch body 12 accommodated inside a housing 10.

The housing 10 is a box shape of a predetermined wall thickness. The latch body 12 is inserted through an opening 14 formed at one end, in the longitudinal direction, of the housing 10. The opening 14 is formed with rectangular frame 16, which is used to mount the housing 10 to audio equipment, and projections 18 (see FIG. 3), which correspond to the rectangular frame 16, on both side surfaces of the housing 10. Mounting plates (not shown) are therefore held between the rectangular frame 16 and the projections 18 to secure the housing 10.

Figure 2:
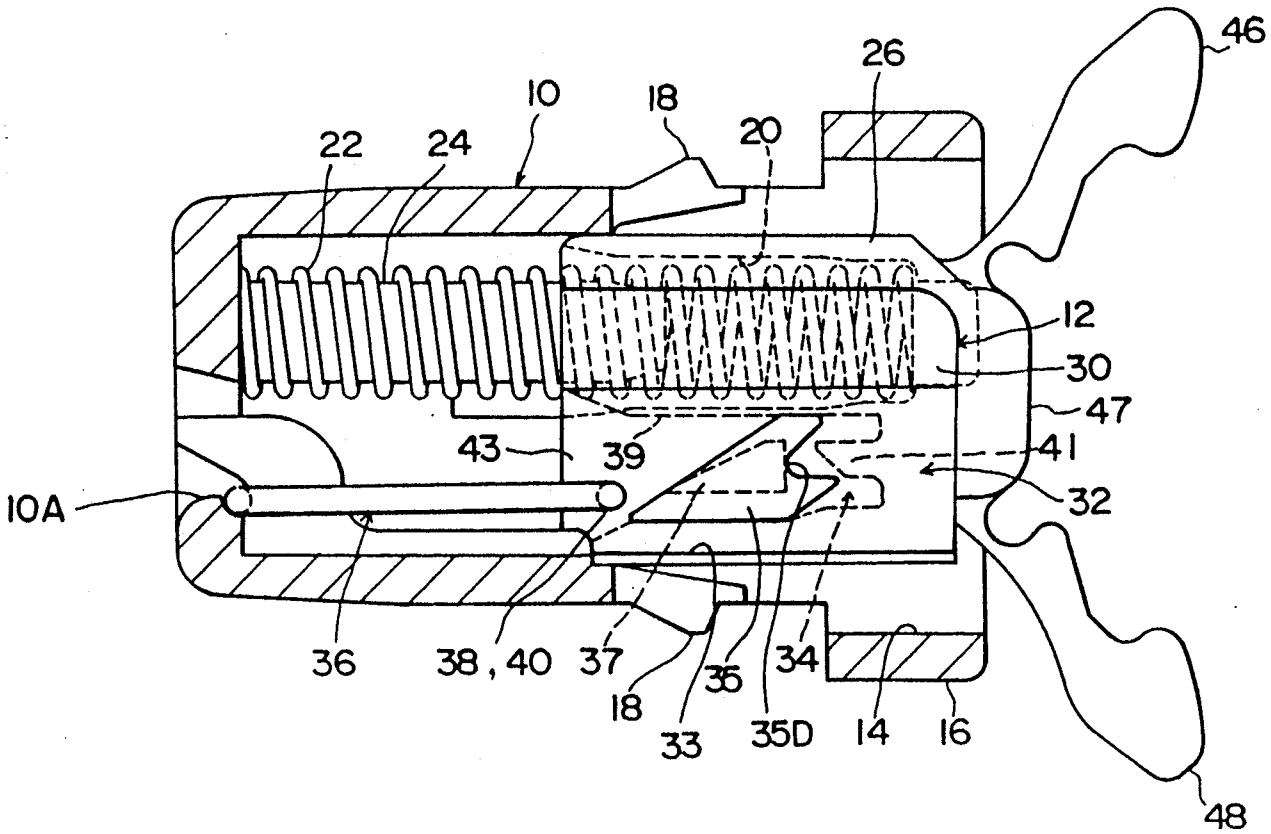
FIG. 2 is a cross-sectional view taken along line 2—2 in FIG. 1, illustrating the latch device according to the first embodiment of the present invention.

As shown in FIG. 2, the latch body 12 inserted in the housing 10 is a substantially rectangular parallelopiped. A circular hole 20 is formed in the longitudinal direction in latch body 12. A compression coil spring 22 is accommodated in the circular hole 20. Part of the compression coil spring 22 is inserted in a spring bracket 24 which projects from the circular hole 20 and protrudes inside the housing 10. The compression coil spring 22 thereby always urges the latch body 12 in a direction in which the latch body 12 is released from the housing 10.

The latch body 12 is formed with concave portions 30 at a top surface 26 and a base (not shown) thereof, respectively. The concave portions 30 are respectively formed with circuital cam grooves 32 and 34. Tracing portions 38 and 40 of a guide lever 36 are respectively inserted into the circuital cam grooves 32 and 34.

As shown in FIG. 1, the guide lever 36 forms substantially C-shape similar to a partly notched rectangular loop. Circumferential side surfaces of such a notch are designated as the tracing portions 38 and 40. A space between the tips of the tracing portions 38 and 40 is larger than a space between the bottom surfaces of the circuital cam grooves 32 and 34. The tips of the tracing portions 38 and 40 therefore do not contact the bottom surfaces of the circuital cam grooves 32 and 34. The tracing portions 38 and 40 are adapted to abut on wall surfaces of the grooves and to circulate.

A rear end portion of the guide lever 36 is secured to a back surface 10A of the housing 10 so as to be swingable.

As illustrated by a solid line in FIG. 2, the circuital cam groove 32 has groove wall surfaces 33, which are formed on both sides thereof in the longitudinal direction of the latch device 12, and a heart-shaped projection 35 of a convex configuration, which is formed between the groove wall surfaces 33.

The other circuital cam groove 34, which is represented by a dashed line, has a triangular projection 37 of a substantially triangular shape formed in a substantially central portion of the circuital cam groove 34, a groove wall surface 39 formed substantially in a direction of circulation of the guide lever 36, and a projection 41 protruding toward a heart-shaped concave portion 35D of the heart-shaped projection 35, from the right of the groove wall surface 39 in the drawing. The planar forms of the groove wall surface 39 and the triangular projection 37 differ from those of the heart-shaped projection 35 and the groove wall surface 33 of the circuital cam groove 32. Accordingly, the tracing portions 38 and 40, which are circulating respectively in the circuital cam grooves 32 and 34, are pushed against the groove wall surfaces 33 and 39 and the wall surfaces of the heart-shaped projection 35 and of the triangular projection 37. The tracing portions 38 and 40 are thereby spaced apart form one another. An end portion 43 of the circuital cam groove 34 is machined into a tapered form, thereby making mounting of the guide lever 36 thereon easy.

Figure 3:
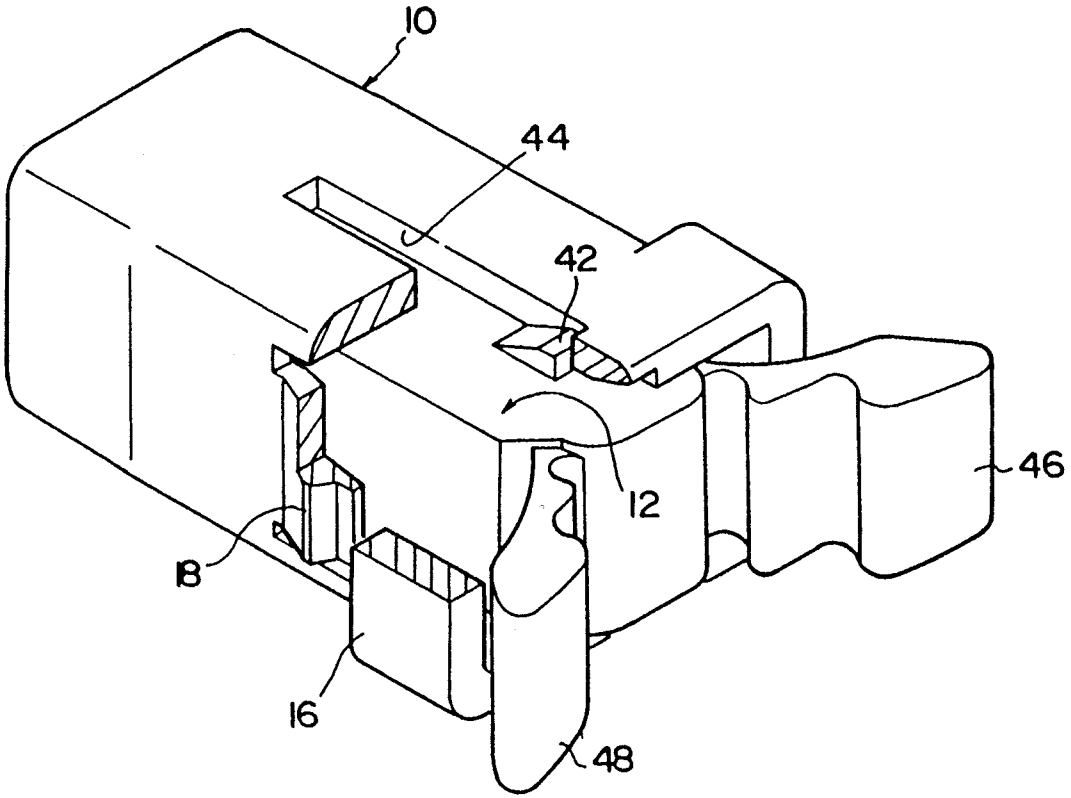
FIG. 3 is a partially broken perspective view as seen from the side of the latch device according to the first embodiment of the present invention.

As shown in FIG. 3, the latch body 12 has a projection 42 formed on a side surface thereof. The projection 42 extends into a guide groove 44 formed in the housing 10. As a result, the latch body 12 is moved reciprocally relative to the housing 10 by the movement of the projection 42 inside the guide groove 44. When the projection 42 is engaged with one end of the guide groove 44, resistance to the urging force of the compression coil spring 22 prevents the latch body 12 from moving in the direction in which the latch body 12 is drawn out.

As shown in FIG. 1, the latch body 12 is provided with a pair of arms 46 and 48 at a side opposite to a portion at which the latch body 12 is inserted in the housing 10. Ends of these arms 46 and 48 are spaced apart from one another and extend radially. From this state, a radially extending end portion 50A of a striker 50, which is attached to a closing cover (not shown), is adapted to force against a central portion 47 of the arms 46 and 48, thereby driving the latch body 12 into the housing 10. When the latch body 12 is driven into the housing 10 by the striker 50, the outer sides of the arms 46 and 48 strike against the opening 14. The arms 46 and 48 then move in the direction in which they approach each other, with hinges 46A and 48A as fulcrums. As a result, the radially extending end portion 50A of the striker 50 is held by the arms 46 and 48 to shut the closing cover.

Operation of the present embodiment will now be described with reference to FIG. 4 through FIG. 12.

Before the latch body 12 is driven by the radially extending end portion 50A of the striker 50 (see FIG. 1), the projection 42 formed on the latch body 12 is engaged with one end of the guide slot 44 (see FIG. 3). The latch body 12 is prevented from being drawn out of the housing 10. At this time, the arms 46 and 48 are opened, and the tracing portions 38 and 40 of the guide lever 36 are positioned on the end portion 43 of the latch body 12, as shown in FIG. 1.

Figure 4:
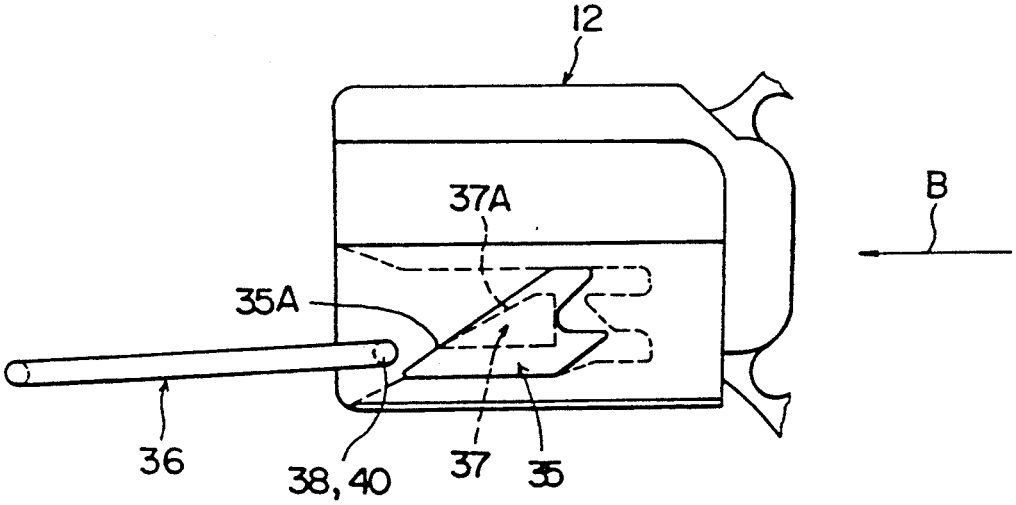
FIG. 4 is a plan view of the latch device according to the first embodiment of the present invention, illustrating a part of one operating cycle of circuital cam grooves and a guide lever.

When the latch body 12 at the position shown in FIG. 4 is driven in the direction of arrow B, the tracing portion 38 is guided along a wall surface 35A of the heart-shaped projection 35. The other tracing portion 40 first follows the tracing portion 38, and is then guided to a wall surface 37A of the triangular projection 37, reaching the position illustrated in FIG. 5.

Figure 5:
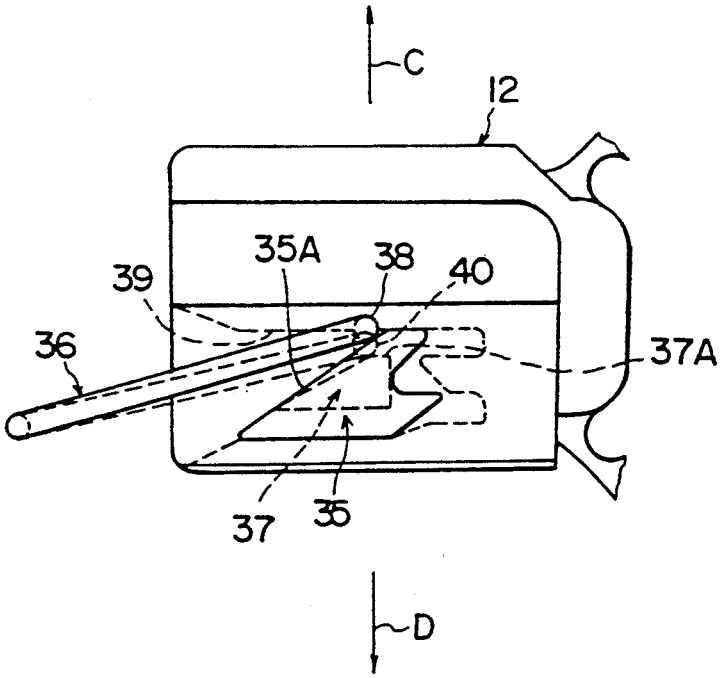
FIG. 5 is a plan view of the latch device according to the first embodiment of the present invention, showing a part of one operating cycle of the circuital cam grooves and the guide lever.

At the position shown in FIG. 5, the tracing portion 38, which was guided to the wall surface 35A of the heart-shaped projection 35, further moves in the direction of arrow C. The tracing portion 40, which was guided to the wall surface 37A of the triangular projection 37, moves in the direction of arrow D. As a result, the tracing portions 38 and 40 are spaced apart and a torsional force is generated in the guide lever 36.

Figure 6:
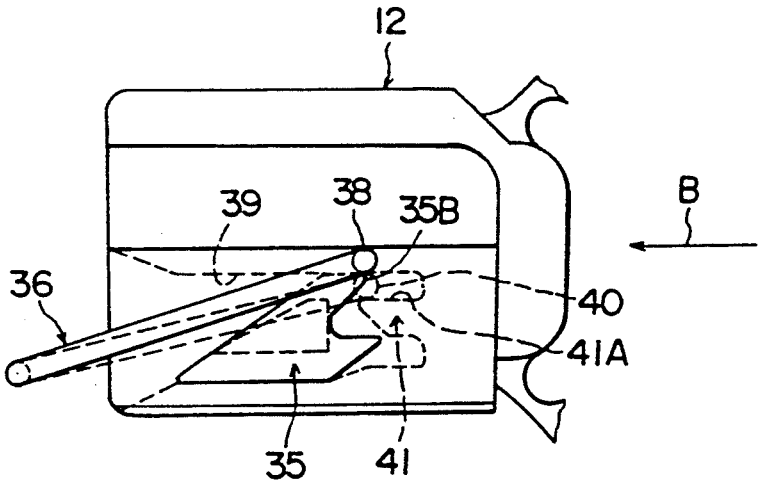
FIG. 6 is a plan view of the latch device according to the first embodiment of the present invention, illustrating a part of one operating cycle of the circuital cam grooves and the guide lever.

As shown in FIG. 6, when the tracing portion 38 reaches a corner 35B of the heart-shaped projection 35, misalignment between the tracing portions 38 and 40 is at a maximum, and the torsional force reaches its maximum. At this time, the tracing portion 40 is engaged with a wall surface 41A of the projection 41.

When the latch body 12 at the position shown in FIG. 6 is further driven in the direction of arrow B, the tracing portion 38 travels across the corner 35B of the heart-shaped projection 35. A restoring force against the torsional force of the guide lever 36 then causes the tracing portion 38 to move in the direction of arrow D, eliminating the torsional force. Because an open portion without groove wall surfaces is provided in the direction in which the tracing portion 38 moves (the direction of arrow D), the tracing portion 38 does not collide with a groove wall surface. Consequently, no sound of impact (operating sound) occurs. Slight movement due to trembling of the guide lever 36 is transmitted to the latch body 12. (See FIG. 7.) The open portion is formed so large that the tracing portion 38 does not strike against the groove wall surface even when the tracing portion 38 is swung by an inertial force in the direction of arrow D beyond the position where the tracing portion 40 is engaged.

Figure 7:
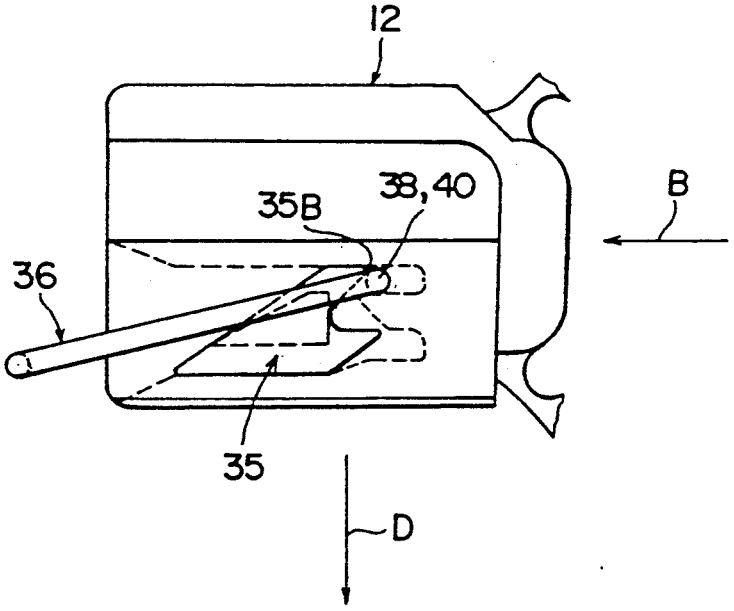
FIG. 7 is a plan view of the latch device according to the first embodiment of the present invention, showing a part of one operating cycle of the circuital cam grooves and the guide lever.
Figure 8:
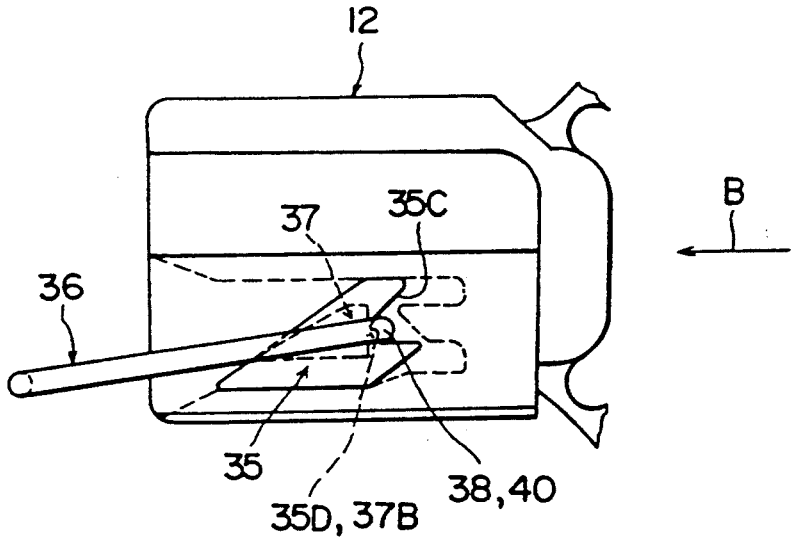
FIG. 8 is a plan view of the latch device according to the first embodiment of the present invention, illustrating a part of one operating cycle of the circuital cam grooves and the guide lever.

The guide lever 36 is guided in the direction of arrow B when an amount of over-stroke from the pushings illustrated in FIG. 6 and FIG. 7 is eliminated by the urging force of the compression coil spring (not shown). The result is that the tracing portion 38 is guided to a wall surface 35C of the heart-shaped projection 35, and is engaged with the heart-shaped concave portion 35D, as illustrated in FIG. 8. The other tracing portion 40 follows the tracing portion 38 and is engaged with a wall surface 37B of the triangular projection 37. The outer sides of the arms 46 and 48 contact the openings 14 until the guide lever 36 reaches the positions of engagement. The arms 46 and 48 then move in directions in which they approach one another, with the hinges 46A and 48A as fulcrums. As a result, the radially extending end portion 50A of the striker 50 is held by the arms 46 and 48 to shut the closing cover.

Figure 9:
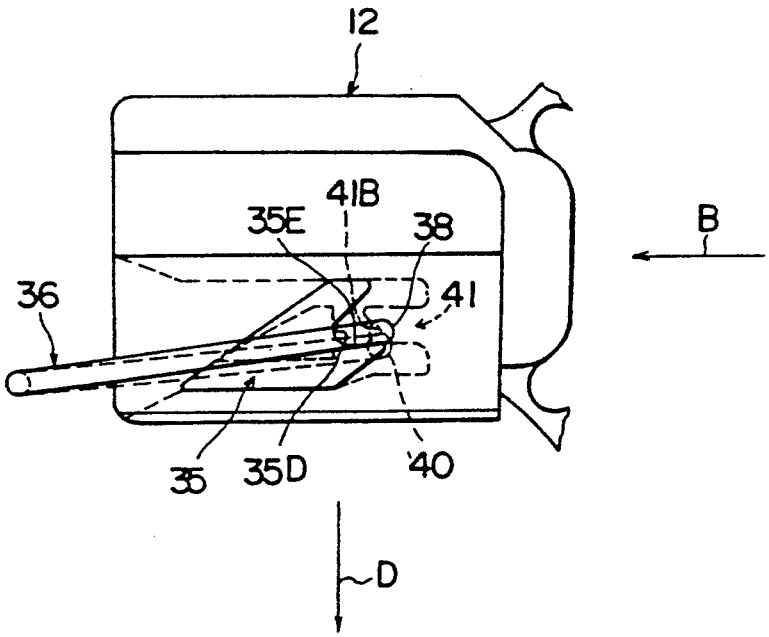
FIG. 9 is a plan view of the latch device according to the first embodiment of the present invention, showing a part of one operating cycle of the circuital cam grooves and the guide lever.

As illustrated in FIG. 9, when the latch body 12 is over-stroked in the direction of arrow B from the position at which the guide lever 36 is engaged, the tracing portion 40 is guided in the direction of arrow D by a wall surface 41B of the projection 41. The tracing portion 38 is guided in the direction opposite arrow B by a wall surface 35E of the heart-shaped projection 35. This produces torsion again in the guide lever 36. Since the heart-shaped concave portion 35D is shifted in the direction of arrow D from the end portion of the projection 41, the tracing portions 38 and 40 will not circulate in the opposite direction when over-stroked.

When the latch body 12 is further over-stroked in the direction of arrow B, the tracing portion 38 travels across an end portion 35F of the wall surface 35E. Misalignment with the tracing portion 40 is then eliminated by the restoring force of the guide lever 36, which reaches the position shown in FIG. 10. Because an open portion without groove wall surfaces is provided in the direction in which the tracing portion 38 moves (the direction of arrow D), the tracing portion 38 does not collide with a groove wall surface. Consequently, no sound of impact (operating sound) occurs. Slight movement due to trembling of the guide lever 36 is transmitted to the latch body 12. The open portion is formed large enough to prevent the tracing portion 38 from striking on a groove wall surface.

Figure 10:
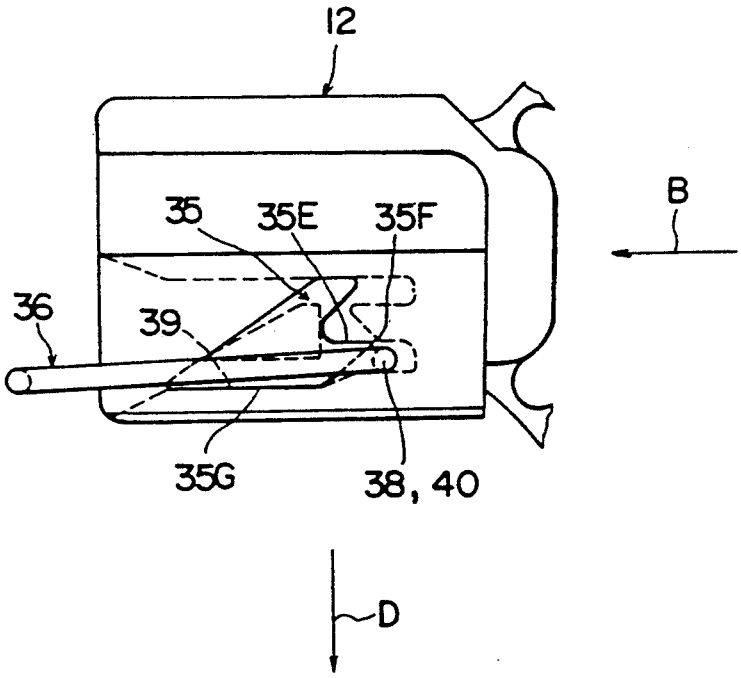
FIG. 10 is a plan view of the latch device according to the first embodiment of the present invention, illustrating a part of one operating cycle of the circuital cam grooves and the guide lever.

The over-stroke of the guide lever 36 at the position shown in FIG. 10 is at a maximum. When the pushing of the guide lever 36 in the direction of arrow B is released, the latch body 12 is forced back in the direction opposite of arrow B by the urging force of the compression coil spring (not shown). However, a corner 35F of the heart-shaped projection 35 interferes with the tracing portion 38, so that the tracing portion 38 cannot move in a direction opposite to the direction of circulation.

When the compression coil spring (not shown) forces the latch body 12 in the direction opposite of arrow B further back from the position shown in FIG. 10, the tracing portions 38 and 40 are guided to a wall surface 35G of the heart-shaped projection 35 and the groove wall surface 39. These tracing portions 38 and 40 are guided in the direction of arrow B while the torsional force is imparted thereto.

Figure 11:
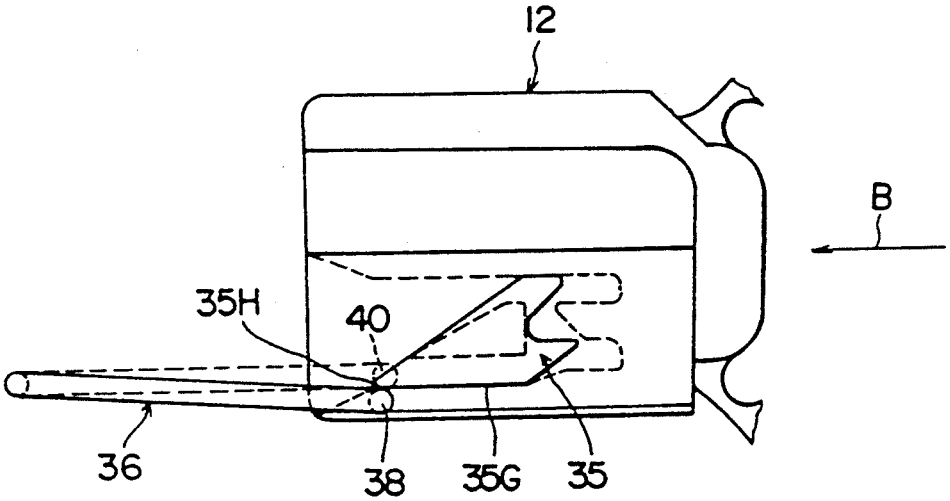
FIG. 11 is a plan view of the latch device according to the first embodiment of the present invention, showing a part of one operating cycle of the circuital cam grooves and the guide lever.

As shown in FIG. 11, the tracing portion 38 is positioned on an end portion 35H of the heart-shaped projection 35. The latch body 12 is further guided in the direction of arrow B by the compression coil spring pushing back. The restoring force caused by the torsion of the guide lever 36 eliminates the misalignment between the tracing portions 38 and 40 at the same time as the tracing portion 38 leaves the end portion 35H of the heart-shaped projection 35. In addition, the compression coil spring draws the latch body 12 back to the state shown in FIG. 4. At this state, the arms 46 and 48 are released from the openings 14, and then pivot in directions in which the arms 46 and 48 move away from one another, with the hinges 46A and 48A as fulcrums. This releases the radially extending end portion 50A of the striker 50 from engagement so that the closing cover is opened.

In this embodiment, the circuital cam grooves are formed on both surfaces of the latch body 12. However, the present embodiment is not limited to the same. The latch body 12 may be provided with two circuital cam grooves on one surface thereof so that the tracing portions are circulated in a given direction by the torsional force generated in the guide lever 36 by differences in shapes of the passage.

A second embodiment will now be described.

Figure 12:
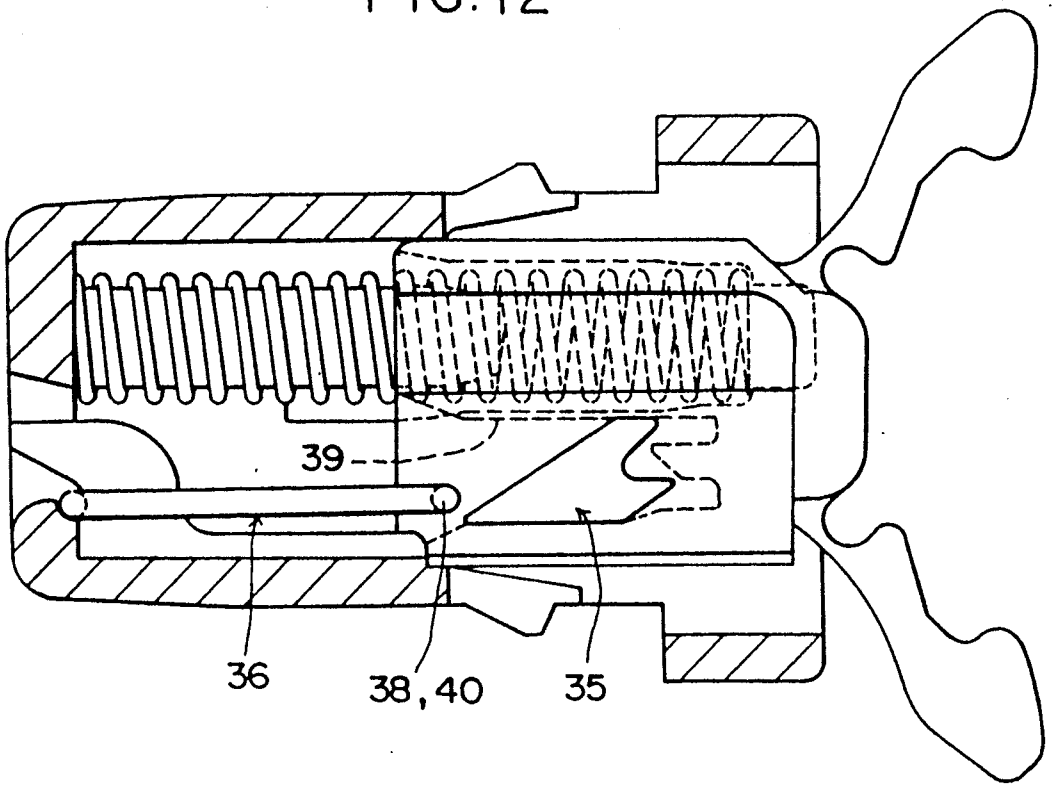
FIG. 12 is a cross-sectional view of the latch device according to a second embodiment of the present invention.
Figure 13:
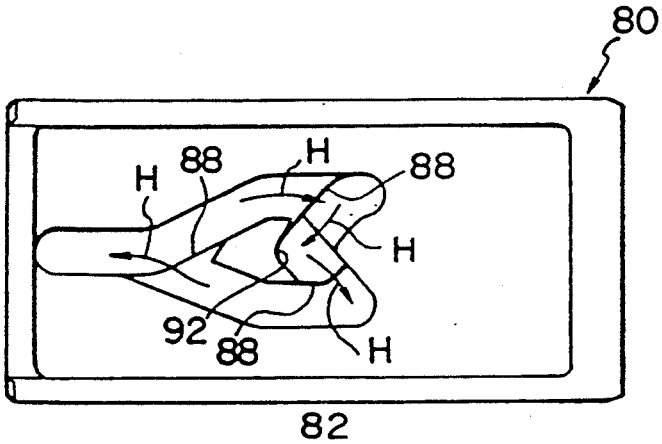
PRIOR ART FIG. 13
FIG. 13 is a plan view showing a circuital cam groove of a conventional latch device.
Figure 14:
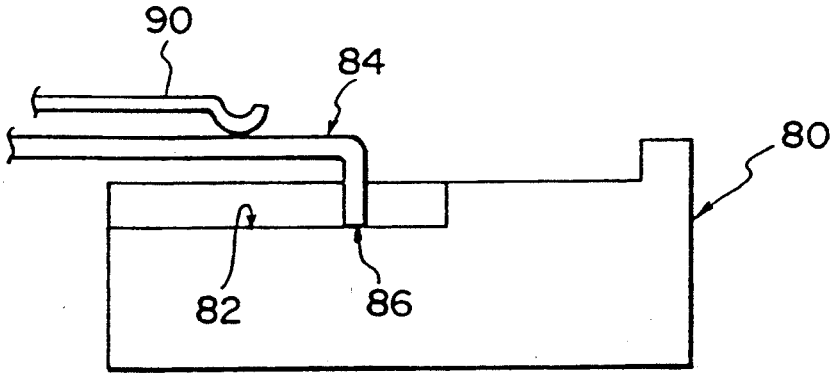
PRIOR ART FIG. 14
FIG. 14 shows a partially sectional view of the conventional latch device.

In the second embodiment, as shown in FIG. 12, the triangular projection 37, which is formed on the circuital cam groove 34 in the first embodiment, is not provided. Accordingly, the tracing portion 40 of the guide lever 36 at the position shown in FIG. 4 follows the tracing portion 38. However, the tracing portion 40 at the position shown in FIG. 5 and FIG. 6 contacts the groove wall surface 39 and moves apart from the tracing portion 38, whereby torsional force is generated. Therefore, movement of the guide lever 36 in the direction of circulation is ensured.

As illustrated in FIG. 8 in the first embodiment, the guide lever 36 is prevented from being drawn out by the tracing portions 38 and 40 being engaged in the heart-shaped concave portion 35D and on the wall surface 37B respectively. In the second embodiment, only the tracing portion 38 is engaged in the heart-shaped concave portion 35D. However, in this case also, the strength of engagement is similar to that derived from conventional latch devices.

Because the triangular projection 37 is omitted in the second embodiment, the mold of the latch body 12 may be parted after being formed, thereby resulting in an improved degree of freedom in processing of products.

What is claimed is:

1. A latch device in which a latch body is engaged in pushed in and released states within a housing, comprising:

first and second circuital cam grooves formed by groove wall surfaces, said circuital cam grooves having different configurations with respect to each other and being disposed respectively in first and second surfaces of said latch body, said first circuital cam groove having an open portion not bounded by said groove wall surfaces of said circuital cam grooves; and tracing members inserted into said circuital cam grooves such that said tracing members are maintained apart from bottom surfaces of said circuital cam grooves;

whereby said tracing members are forced toward the groove wall surfaces of said circuital cam grooves by movement of said latch body, one of said tracing members moving toward said open portion by a restoring force acting opposite a torsional force generated by relative displacement of said tracing members with respect to each other, whereby the torsional force is eliminated, said tracing members alternately retaining said latch body in pushed in and released states with each thrust of said latch body.

2. The latch device of claim 1, wherein said first circuital cam groove is provided with a heart-shaped projection of a convex configuration in a substantially central portion of a concave portion of said latch body, said heart-shaped projection having a depression extending along a direction in which said latch body is released.

3. The latch device of claim 1, wherein said second circuital cam groove is provided with a triangular projection of a substantially triangular shape in a substantially central portion of said second circuital cam groove, a base of said triangular projection extending along a direction in which said latch body is released.

4. The latch device of claim 1, wherein end portions of said circuital cam grooves are tapered.

5. The latch device of claim 2, wherein said open portion is provided in said first circuital cam groove to allow unobstructed movement of one of said tracing members due to said restoring force, said open portion being located adjacent to said depression of said heart-shaped projection.

6. The latch device of claim 1, wherein said tracing members are formed by a round bar machined into a substantially C-shape, ends of the round bar being bent in directions which cause the ends to face one another so that circumferential edges of the ends may contact the groove wall surfaces of said circuital cam grooves.

7. A latch device in which a latch body is engaged in pushed in and released states within a housing, comprising:

first and second circuital cam grooves formed by groove wall surfaces, said circuital cam grooves having different configurations with respect to each other, said circuital cam grooves formed in one surface of said latch body, said first circuital cam groove having an open portion not bounded by groove wall surfaces of said circuital cam grooves; and tracing members inserted into said circuital cam grooves such that said tracing members are maintained apart from bottom surfaces of said circuital cam grooves;

whereby said tracing members are forced toward the groove wall surfaces of said circuital cam grooves by movement of said latch body, at least one of said tracing members moving toward said open portion by a restoring force acting opposite a torsional force generated by relative displacement of said tracing members with respect to each other, whereby the torsional force is eliminated, said tracing members alternately retaining said latch body in pushed in and released states with each thrust of said latch body.

8. The latch device of claim 7, wherein said first circuital cam groove is provided with a heart-shaped projection of a convex configuration in a substantially central portion of a concave portion of said latch body, said heart-shaped projection having a depression extending along a direction in which said latch body is released.

9. The latch device of claim 7, wherein said second circuital cam groove is provided with a triangular projection of a substantially triangular shape in a substantially central portion of said second circuital cam groove, a base of said triangular projection extending along a direction in which said latch body is released.

10. The latch device of claim 7, wherein end portions of said circuital cam grooves are tapered.

11. The latch device of claim 8, wherein said open portion is provided in said first circuital cam groove to allow unobstructed movement of one of said tracing members due to said restoring force, said open portion being located adjacent to said depression of said heart-shaped projection.

12. The latch device of claim 7, wherein said tracing members are formed by a round bar machined into a substantially C-shape, ends of the round bar extending so as to be parallel to one another so that circumferential edges of the ends may contact the groove wall surfaces of said circuital cam grooves.

* * * * *